US006089514A

United States Patent [19]

Huang et al.

[11] Patent Number: 6,089,514

[45] Date of Patent: Jul. 18, 2000

[54] SWING-ARM BAGGING RACK FOR SUPPORTING MULTIPLE STYLES OF PACKS OF PLASTIC BAG

[75] Inventors: Frank Feng Jung Huang; Daniel C. Huang, both of Tustin, Calif.

[73] Assignee: Durabag Co., Inc., Tustin, Calif.

[21] Appl. No.: 09/149,891

[22] Filed: Sep. 8, 1998

[51] Int. Cl.[7] ..... B65B 67/12; B65B 67/04

[52] U.S. Cl. ..... 248/99; 248/95

[58] Field of Search ..... 248/100, 95, 97, 248/99, 101; 220/495.11; 383/8, 9, 37; 206/554; 211/106, 59.1, 12

[56] References Cited

U.S. PATENT DOCUMENTS

| | | | |
|---|---|---|---|
| 1,163,101 | 12/1915 | Megill | 211/106 |
| 1,453,885 | 5/1923 | Nelson | 211/106 |
| 4,295,619 | 10/1981 | Kuiln et al. | 248/95 |
| 4,538,783 | 9/1985 | Stobbe | 248/100 |
| 4,579,307 | 4/1986 | Mailk | 248/99 |
| 4,840,336 | 6/1989 | Stroh et al. | 248/97 |
| 4,858,862 | 8/1989 | Prader | 248/99 |
| 4,863,125 | 9/1989 | Bateman | 248/100 |
| 5,513,823 | 5/1996 | Bresnahan | 248/99 |

FOREIGN PATENT DOCUMENTS

| | | | |
|---|---|---|---|
| 267234 | 3/1950 | Switzerland | 248/95 |

*Primary Examiner*—Anita M. King
*Assistant Examiner*—Michael Nornberg
*Attorney, Agent, or Firm*—Christie, Parker & Hale, LLP

[57] ABSTRACT

A swing-arm bagging rack for use in simultaneously carrying multiple styles of packs of plastic bags. Swing arm bagging rack has a back portion with left and right sides. A first arm portion is attached with first hinges to right side of the back portion and a second and third arm portions are attached via a second hinge to the left side of the back portion. The first and second arm portions are for carrying a first pack of bags and the third arm portion has uprights positioned thereon to carry a second pack of bags. A fourth arm portion is hingedly attached to the front of third arm portion.

18 Claims, 9 Drawing Sheets

78
70
82
76
80
77
86
84
74
18
90
72
88
92
20

SWING-ARM BAGGING RACK FOR SUPPORTING MULTIPLE STYLES OF PACKS OF PLASTIC BAG

BACKGROUND OF THE INVENTION

1. Field of the Invention

This invention relates to racks for plastic bags, and more particularly to a swing-arm bagging rack suitable for simultaneously supporting and carrying multiple styles and or sizes of packs of plastic bags, which rack is particularly appropriate for use in confined areas.

2. Description of the Prior Art

There are numerous prior art racks for holding bags and sacks, including U.S. Pat. No. 461,291 with spring means to adjust the angle at which two swing arms extend from a back plate to allow for quick release of a mail bag.

However, there do not appear to be any swing-arm bagging rack ideally suited for simultaneously supporting and carrying multiple styles of packs of plastic bags in confined areas, such as plastic merchandise bags and T-shirt bags in the retail environment.

SUMMARY OF THE INVENTION

The present invention provides a swing-arm bagging rack ideally suited to simultaneously support multiple sizes and styles of packs of plastic bags in a space saving manner.

The invention has at least three swing arms to allow at least two different packs of bags to be carried on the rack simultaneously.

The invention is also adapted to be swung into a closed position which occupies less space when not in use.

These and other aspects of the invention are met by providing a swing-arm bagging rack for use in simultaneously carrying multiple styles of packs of plastic bags, comprising a back portion with left and right sides, a first arm portion attached with first hinge means to one of the left and right sides of back portion, and a second and third arm portions attached with second hinge means to the other of the left and right sides of back portion; wherein the first and second arm portions are adapted to carrying a first pack of bags and the third arm portion has bag pack retention means positioned thereon to carry a second pack of bags.

DESCRIPTION OF THE PREFERRED EMBODIMENT

Figure 1:
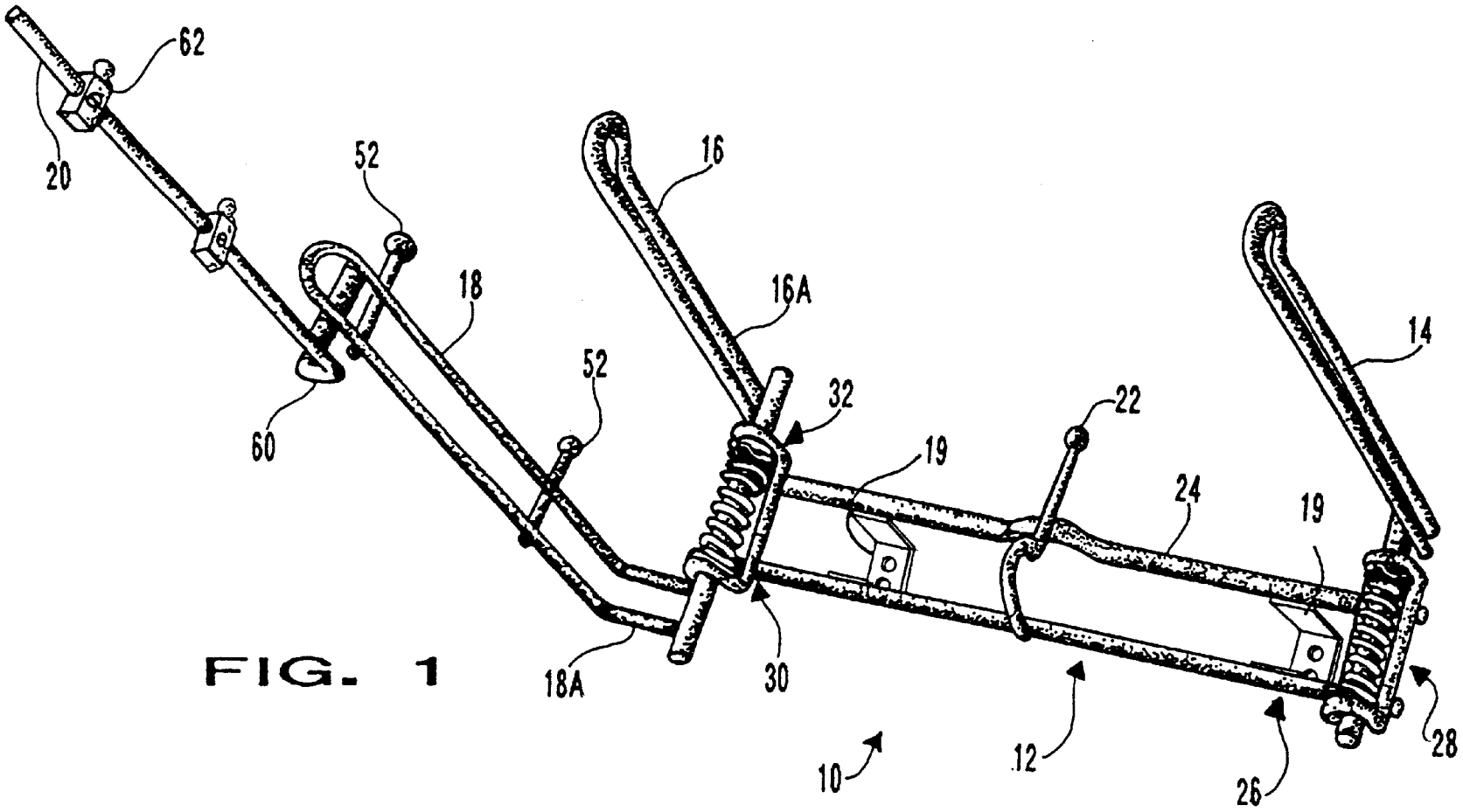
FIG. 1 is a perspective view of a first embodiment of a swing-arm bagging rack of the invention.
Figure 3A:
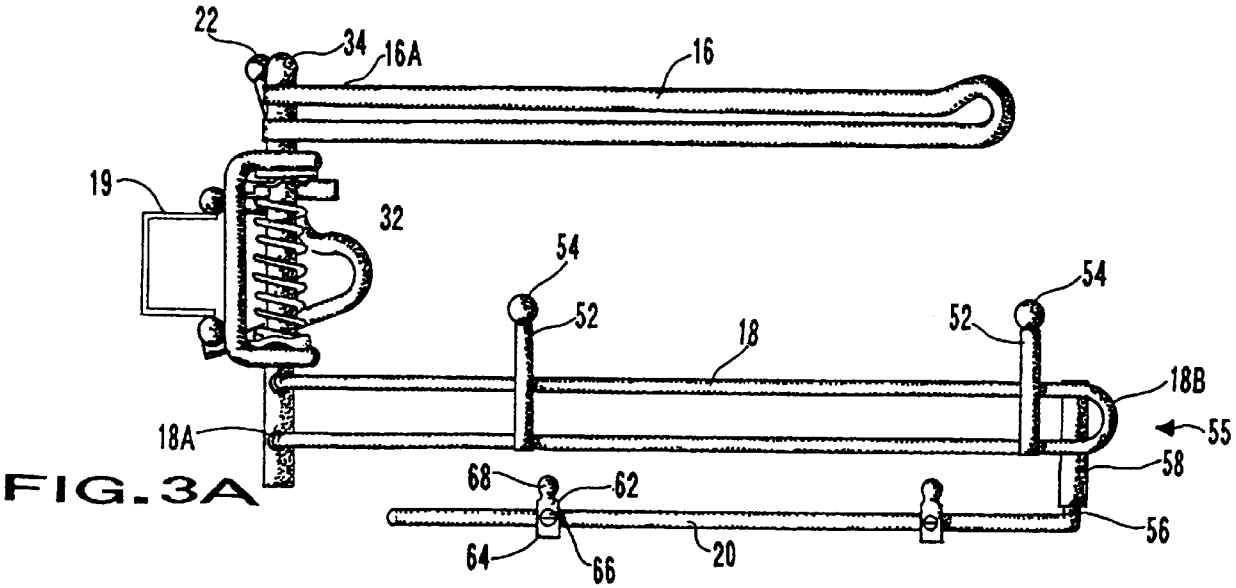
FIG. 3A is a left side plan view of the swing-arm bagging rack of the invention of FIG. 2A.
Figure 3B:
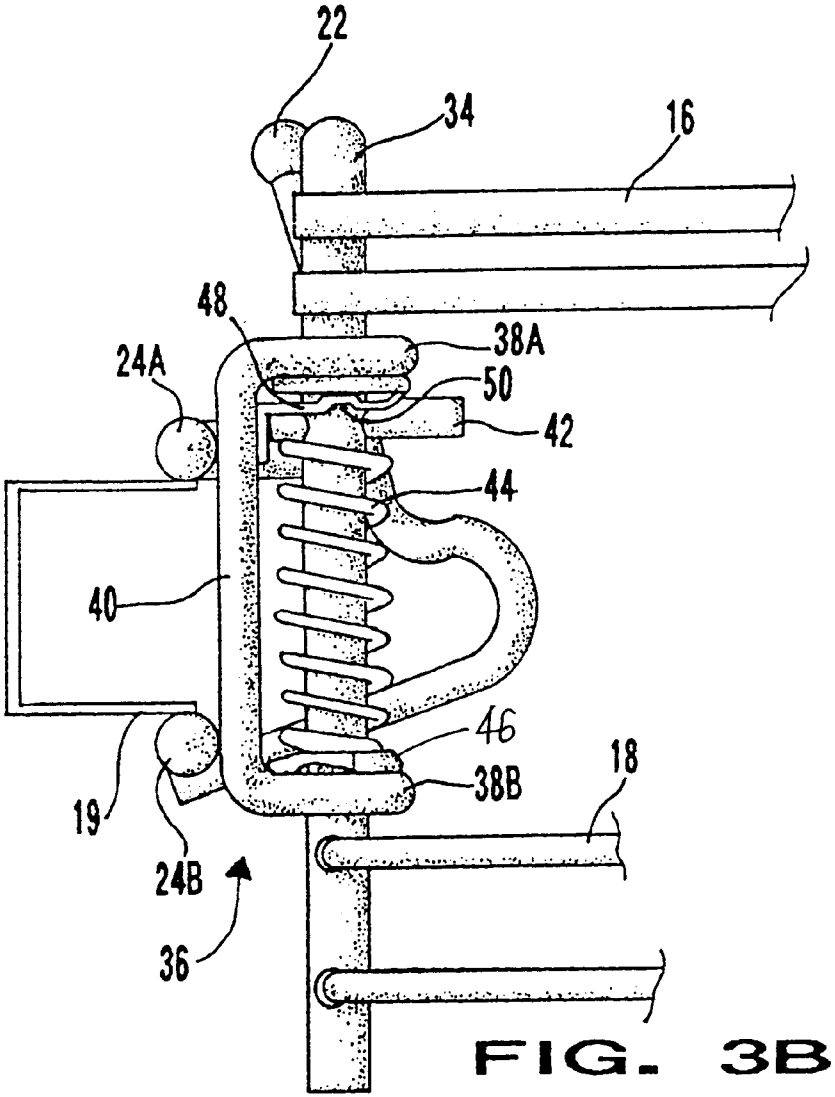
FIG. 3B is a detail of the left side plan view of the swing-arm bagging rack of the invention of FIG. 3A.
Figure 2B:
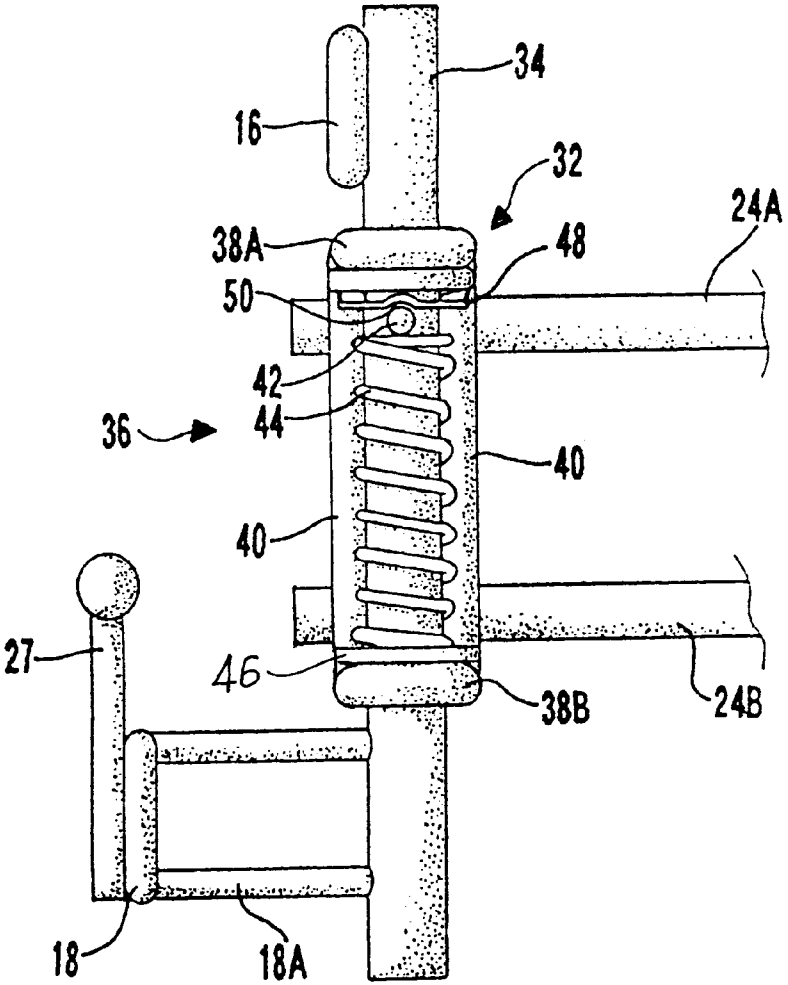
FIG. 2B is a detail partial front plan view of the swing-arm bagging rack of the invention of FIG. 1.

Referring to FIG. 1, reference numeral 10 designates a first embodiment of a swing-arm bagging rack of the invention. First embodiment of a swing-arm bagging rack of the invention 10 comprises aback portion 12, and movable arm portions 14, 16, 18 and 20. Arm portions 14, 16, and 18 are movably attached to back portion 12, and arm portion 20 is movably attached to arm portion 18. Wall brackets 19 are affixed to extend rearwardly from the back of back portion 12 (as shown in FIG. 3) and allow swing-arm bagging rack 10 to be attached to a wall (not shown.) In lieu of being separate bracket components, wall brackets 19 can alternately be integral with back portion 12 (not shown.) A catch means 22 for use in placing through an aperture in a pack of bags (not shown) is preferably located on back portion 12 and extends upwardly from the top of back portion. Catch means 22 can comprise a section of rod material with an enlarged head extending upwardly from an upper edge 24 of back portion 12. Arm portion 14 is movably attached to a right side 26 of back portion 12 with hinge means 28, and arm portions 16 and 18 are movably attached to a left side 30 of back portion 12 with hinge means 32. Arm portions 14 and 16 are adapted to carry the handles of a pack of T-shirt bags and catch means is adapted to support a central tab of a pack of T-shirt bags (not shown.) Bag uprights 52 are located on arm portions 18.

Referring to FIGS. 2A, 2B, 3A, and 3B one type of hinge means 32 is shown. Hinge means 28 will preferably have the same construction as hinge means 32. Hinge means 32 comprises a rod 34 which extends through a carrier portion 36. Rod 34 can conveniently comprise a section of round metal stock. Carrier portion 36 is affixed to back portion 12 (e.g. by welding) and has upper and lower rounded or U-shaped ends 38A and 38B connected together with two straight sections 40. Rod 34, which preferably comprises round stock material, will ride against the inside of rounded U-shaped ends 38A and 38B. Back portion 12 can comprise two metal rods 24A and 24B, or a section of strap, or other materials (not shown.) Arm portion 16 is affixed at a first end 16A to a portion of rod 34 extending above U-shaped end 38A, and arm portion 18 is affixed to a portion of rod 34 extending below U-shaped end 38B. A protrusion means, such as a pin 42 is located in rod 34 slightly below U-shaped end 38A. A compression spring 44 is positioned around the portion of rod 34 inside of the carrier portion 36 and rides on upper side of U-shaped end 38B. Compression spring 44 preferably rides on a washer 46 positioned below protrusion means 42. Preferably, a position retention plate 48 with two furrows 50 formed in a bottom side of position retention plate 48 is permanently affixed to carrier portion 36, preferably below U-shaped end 38A. Two furrows 50 cross each other at about a 90° angle and are designed to receive protrusion 44. Compression spring 42 tends to force pin 44 into contact with position retention plate 48 and thereby place rod 34 under tension, and when rod 34 is oriented such that pin 42 is pushed into one of the furrows 50, this helps to retain arm portions 16 and 18 at either a 90° or 180° angle with respect to back portion 12. Of course, while compression spring 44 tends to keep arms 16 and 18 at the desired angle with respect to back portion 12, arms 16 and 18 can be moved to any other desired position. Also, the relative position of protrusion 42, position retention plate 48, and washer 46 can be flipped to be above U-shaped end 38B. Other, known types of hinge means 36 can be used to hingeably connect together arm portions 14, 16 and 18 to back portion 20.

Figure 2A:
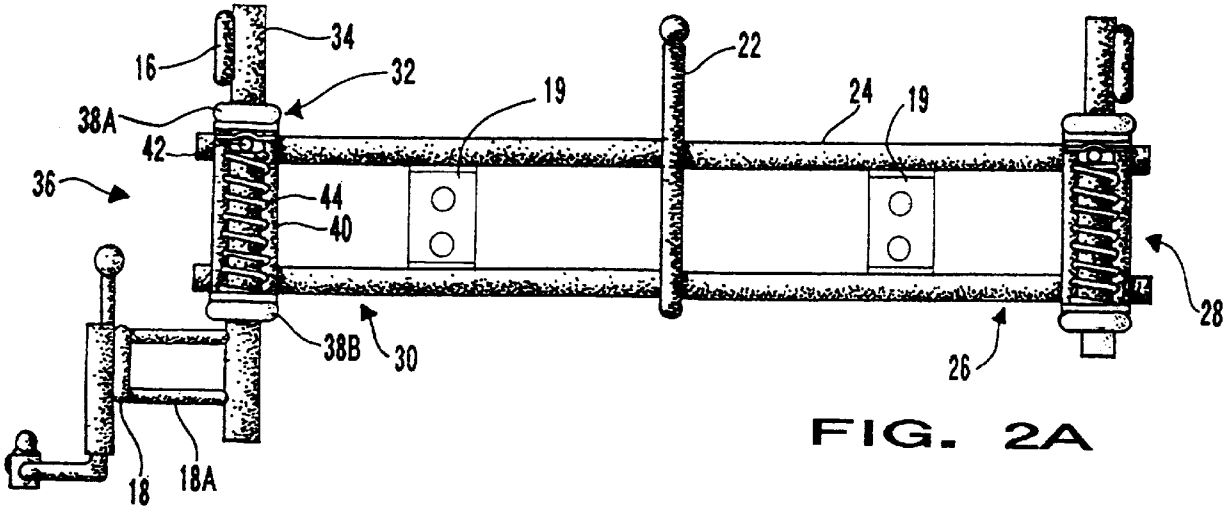
FIG. 2A is a partial front plan view of the swing-arm bagging rack of the invention of FIG. 1.
Figure 5:
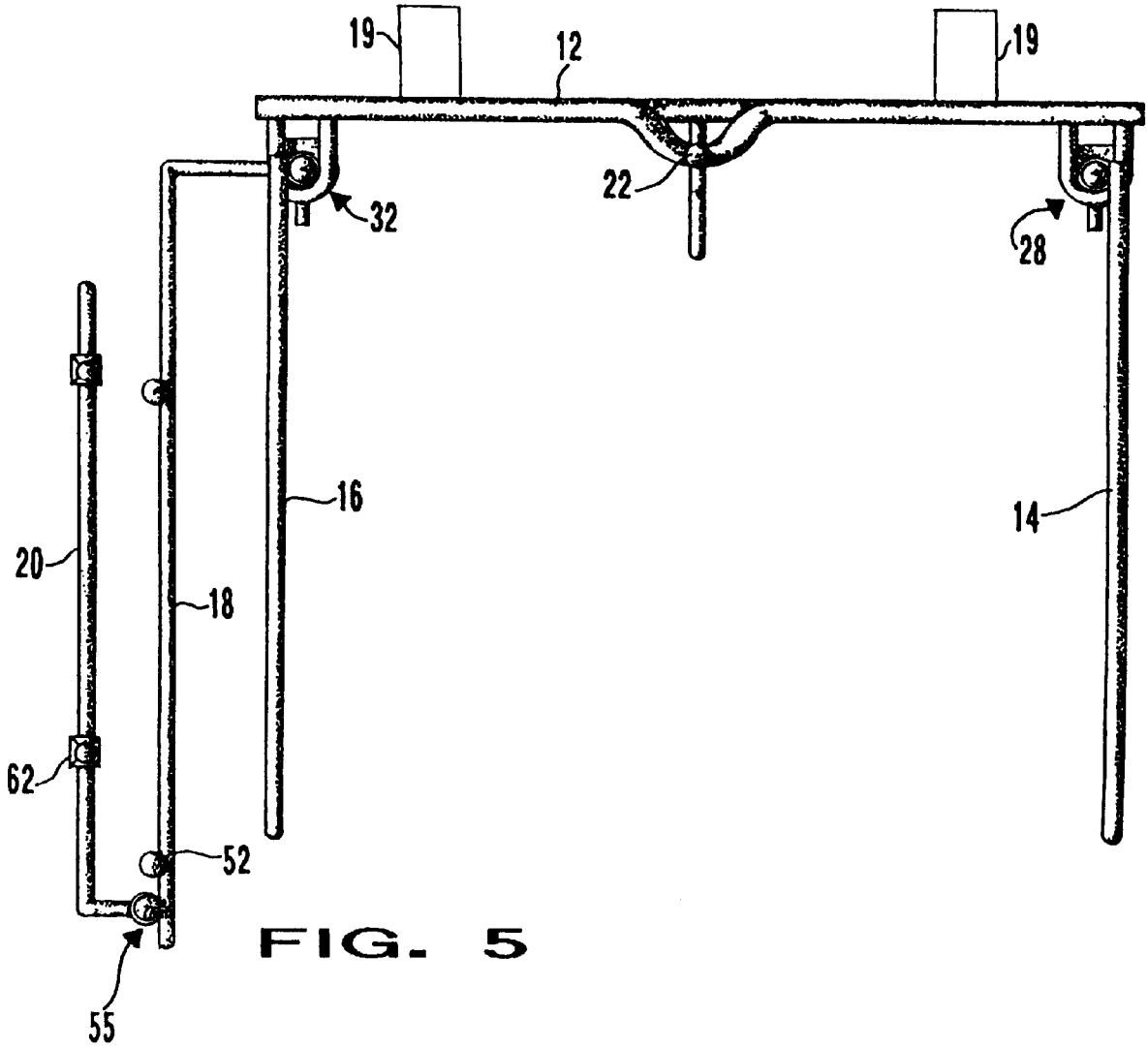
FIG. 5 is a top plan view of the swing-arm bagging rack of the invention of FIG. 1 with its fourth arm portion deployed in an unextended position.

As shown in FIGS. 1 and 2A, arm portion 18 preferably has a short bent section 18A which joins arm portion to rod 34 and which displaces arm portion 18 a distance from rod 34. Each of arm portions 14 and 16 can be formed with a single section of rod, or can comprise two generally closely spaced apart sections of rods. Arm portion 18 can likewise comprise two rod sections that are closely spaced (not shown), or two spaced apart sections of rod. Bag pack retention means, such as uprights 52 are located on arm portion 18. Uprights 52 are adapted to permit merchandise bags, T-shirt bags, and header bags to be suspended from arm portion 18. Uprights 52 can be permanently affixed to arm portion 18, or can be movably attached thereto (not shown.) Uprights 52 can comprise a short section of rod with a slightly enlarged head 54. Arm portion 20 pivotally attaches to distal end 18B of arm portion 18. A simplified type of pivot joint 55 can be used to pivotally attach arm portion 20 to arm portion 18. For example, this can be accomplished by arm portion 20 having a bent portion 56 pivotally extend into a sleeve 58 affixed to end 18B of arm portion 18, with bent portion 56 being prevented from being withdrawn from sleeve 58. Bent portion 56 can snugly fit into sleeve 58 so as to prevent arm 20 from swiveling too easily. As shown in FIGS. 1, 2, and 5, arm portion 20 also has another bent portion 60 that extends arm portion 20 in front of a line parallel to arm portion 18 when pointed forward, and when arm portion 20 is turned to point backwards to back portion 12, arm portion 20 extends below and in a parallel line behind arm portion 18. A pair of bag engagement means 62 are provided on arm portion 20. The position of bag engagement means 62 are preferably adjustable on arm portion 20, and can comprise a body portion 64 with an opening formed therethrough through which arm portion 20 fits, and a tightening means such as a screw (or thumb screw) 66 to lock adjustable bag engagement means 60 at a desired position on arm portion 20. An extension portion 68 extends upwardly from body portion 64 and is used for suspending a bag pack thereon. Extension portion 68 can have an enlarged head.

Figure 4:
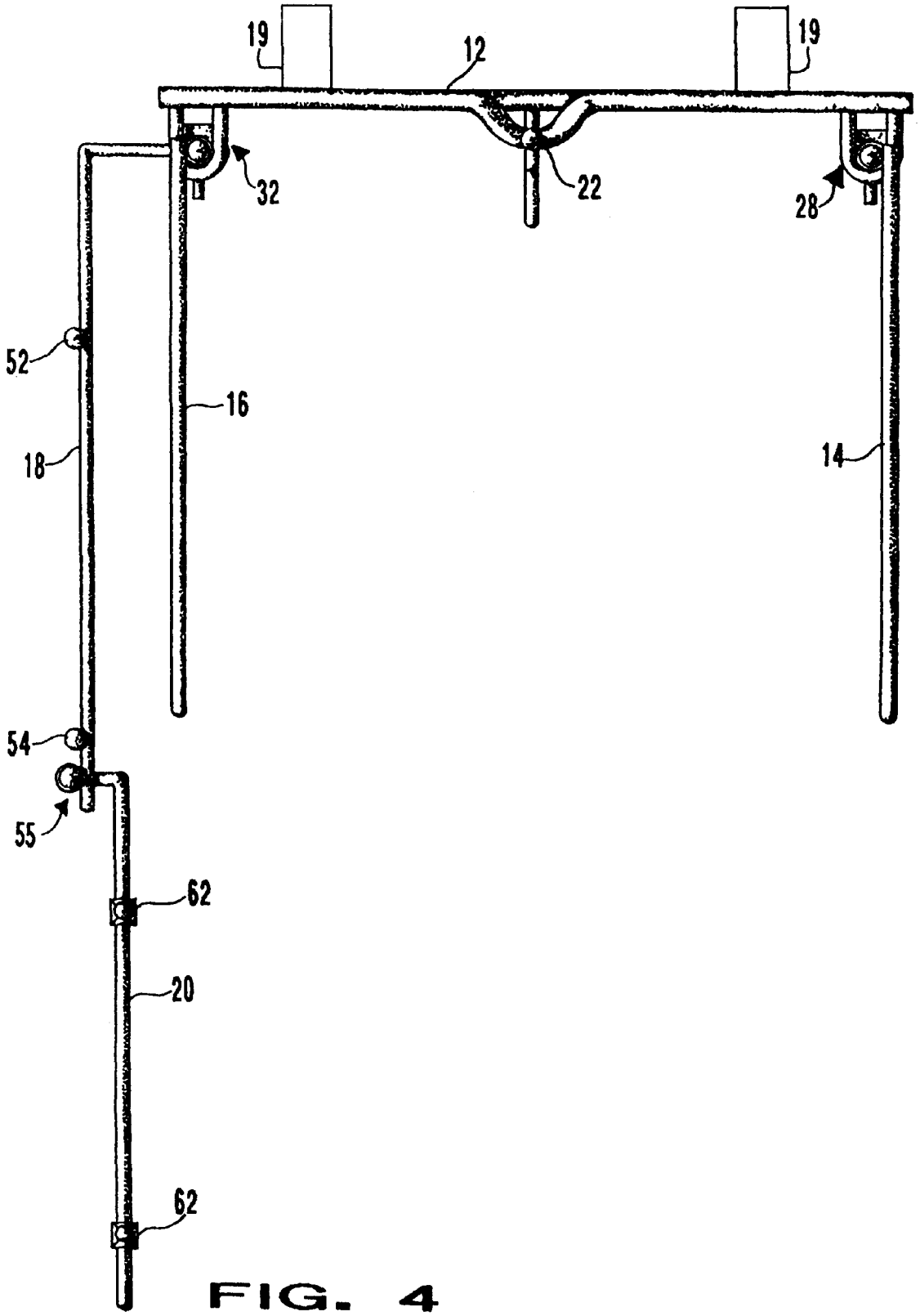
FIG. 4 is a top plan view of the first embodiment of a swing-arm bagging rack of the invention of FIG. 1 with its fourth arm portion deployed in an extended position.
Figure 6:
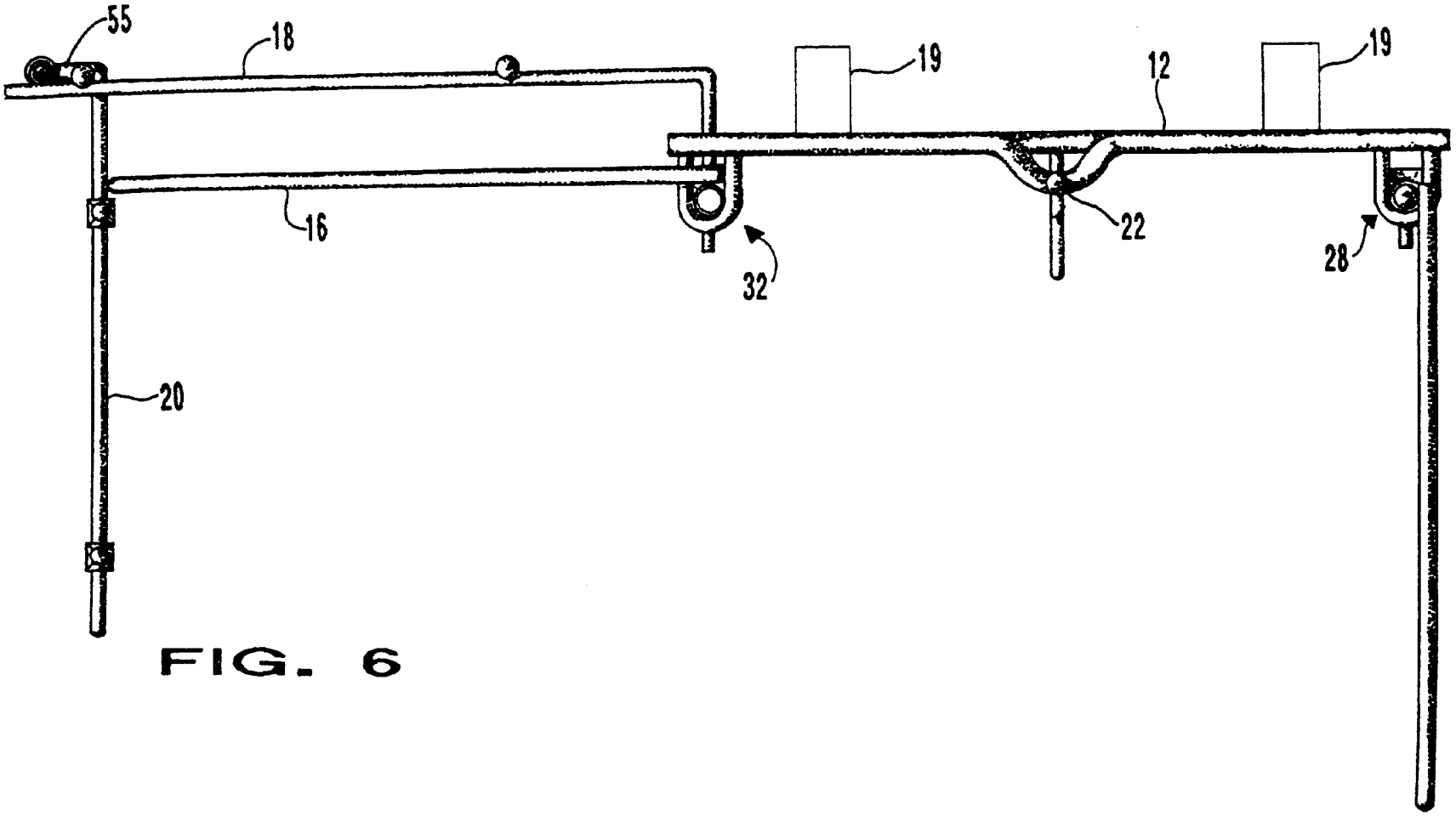
FIG. 6 is a top plan view of the swing-arm bagging rack of the invention of FIG. 1 with its second and third arms folded backwardly and with its fourth arm portion deployed in an extended position.

Turning to FIG. 4, a top view of swing-arm bagging rack 10 is shown with arm portion 20 extending forward of and in front of arm portion 18. FIG. 5 is a top view of swing-arm bagging rack 10 shown with arm portion 20 extending backwards to arm portion 18, and is in a line generally parallel to and behind the line of arm portion 18. FIG. 6 is a top view of swing-arm bagging rack 10 shown with arm portion 16 and 18 in a line generally parallel to back portion 12, and with arm portion 20 perpendicular to arm portions 16 and 18 and extending forward.

Although arm portions 16 and 18 are shown hinged to the left side 30 of back portion 12, arm portions 16, 18 and 20 can equally well be located on the right side 26 of back portion 12, or alternately, three arm portions can be positioned on both the right and left sides 26 and 30 of back portion (not shown.)

Figure 7:
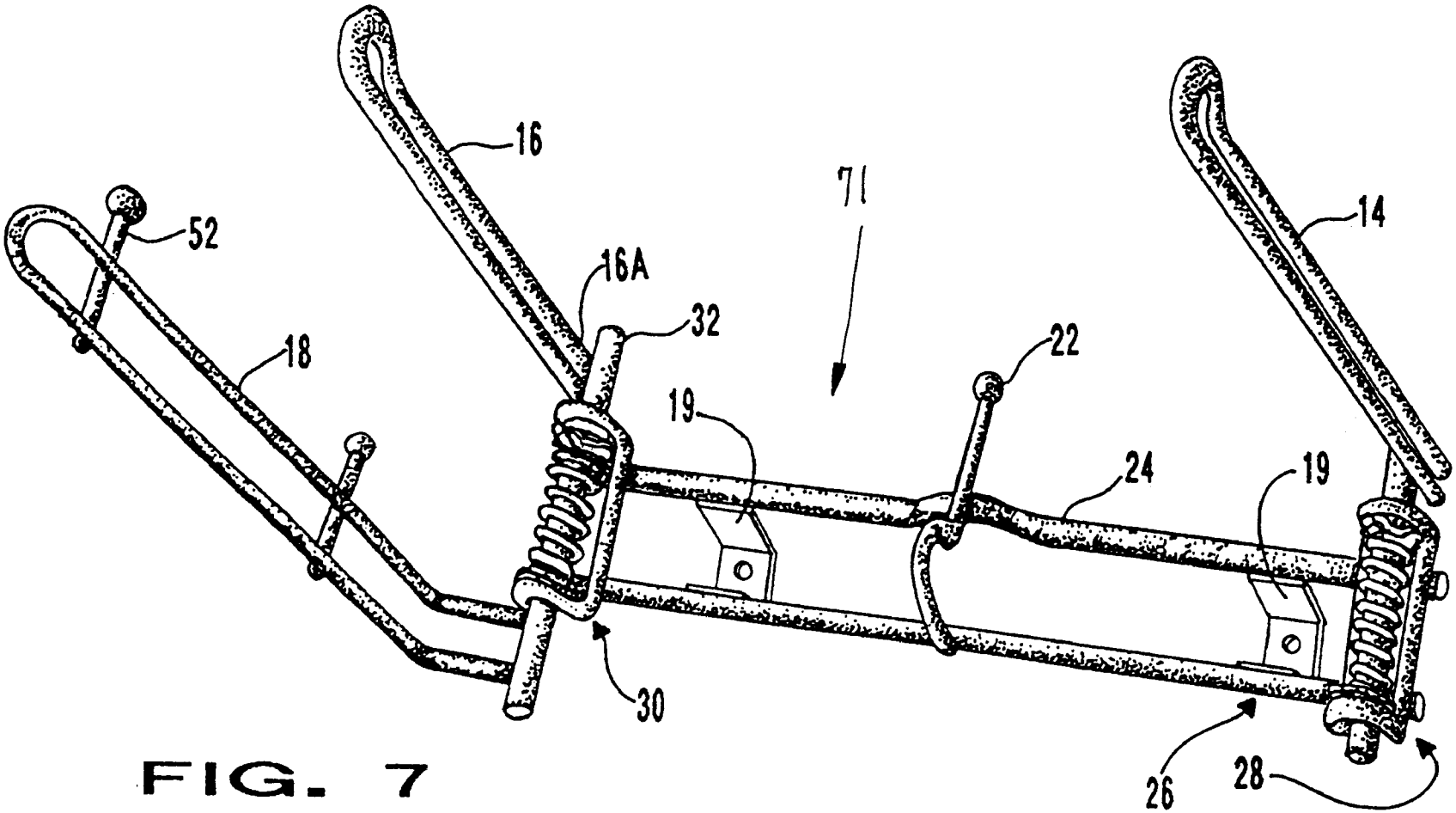
FIG. 7 is a perspective view of a second embodiment of a swing-arm bagging rack of the invention.

Referring to FIG. 7, a second embodiment of the swing-arm bagging rack 71 is shown, which is similar to the first embodiment of FIGS. 1–6, except that it does not include a swing arm 20. It includes a back portion 12, arm portions 14, 16, and 18, wall brackets 19, catch means 22, and hinge means 28 and 32. Swing-arm bagging rack 80 is useful when only up to two bag packs need to be carried.

Figure 8:
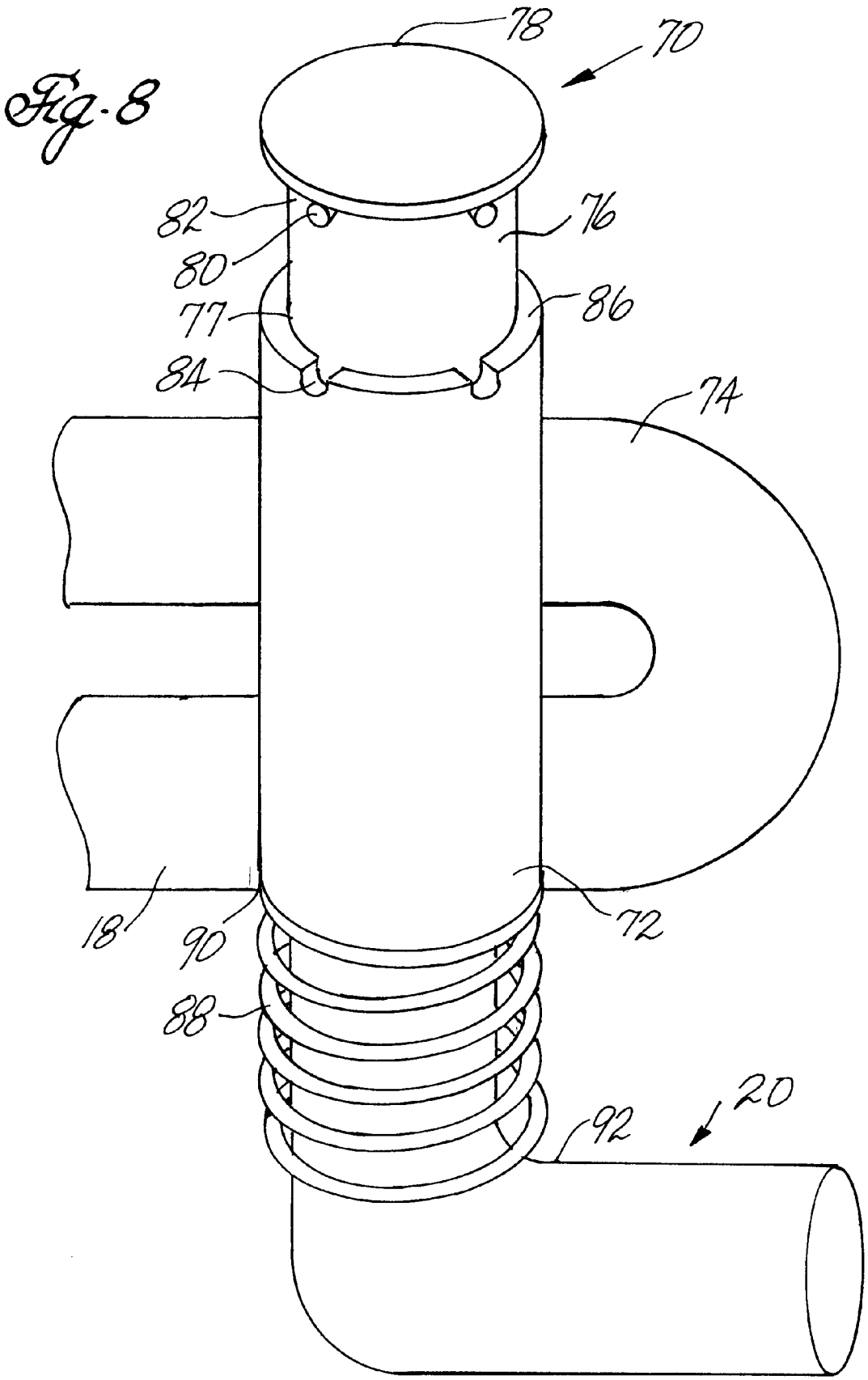
FIG. 8 is side perspective view of an locking hinge design for the fourth swing arm.
Figure 9:
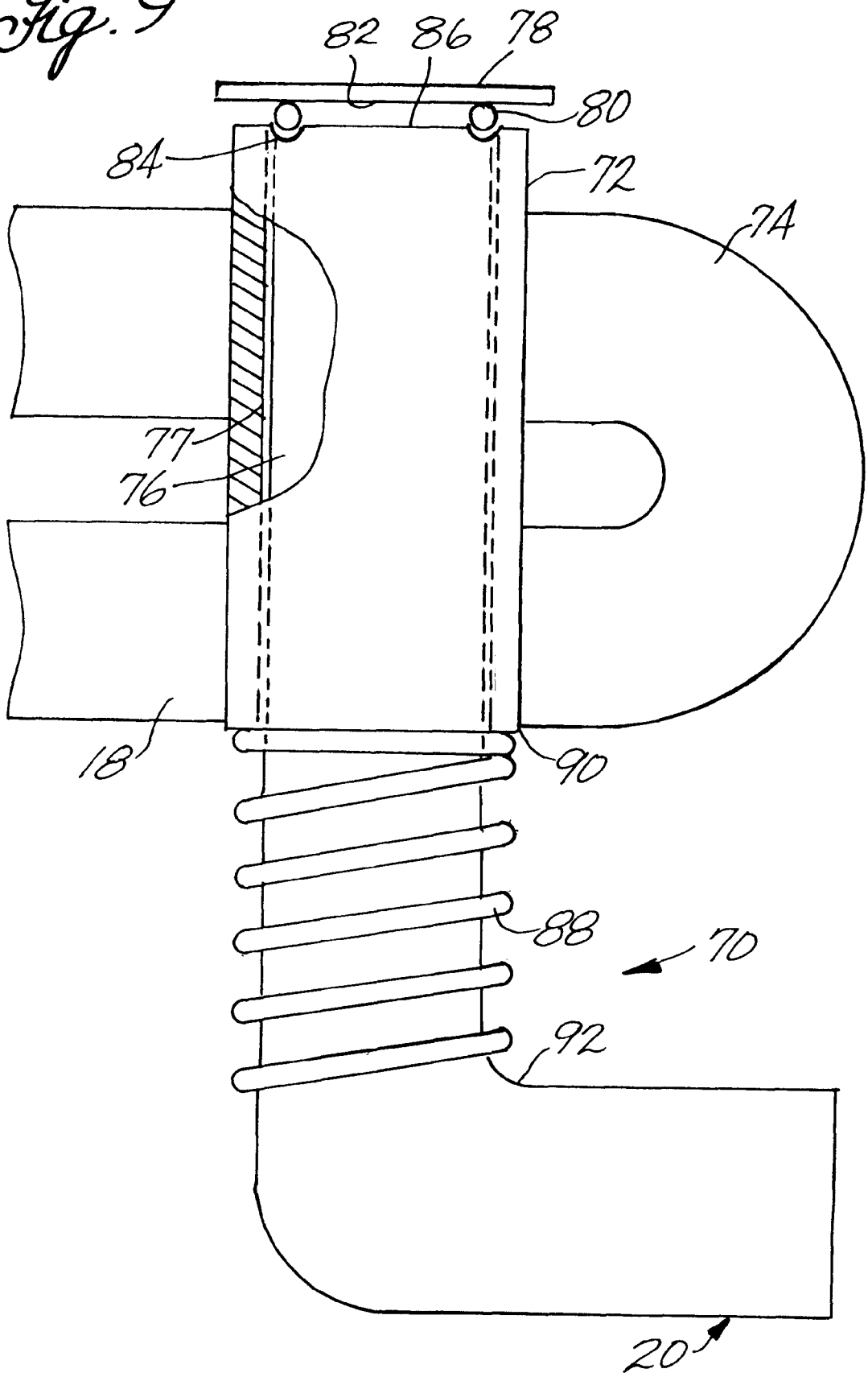
FIG. 9 is a partially exposed side view of the locking hinge design for the fourth swing arm of FIG. 8.

Turning to FIGS. 8 and 9, an alternate locking hinge design 70 for fourth swing arm 20 can be incorporated in the swing arm rack 10. In the particular locking hinge design 70, a tubular portion 72 is affixed to end 74 of third swing arm portion 18. A bent cylindrical portion 76 of fourth swing arm 20 pivotally fits into a central bore 77 of tubular portion 72. A retention cap 78 is fixed on end of cylindrical portion 76. Protrusion means, such as a spherical ball or balls or rods 80 are affixed at junction 82 of retention cap 78 and cylindrical portion 76. Rounded notches 84 are formed at upper edge 86 of tubular portion 72. Biasing spring means 88 is placed around bent cylindrical portion 76 of fourth swing arm 20 between a lower edge 90 of tubular portion 72 and top edge 92 of fourth swing arm 20. Biasing spring means 88 tends to pull bent cylindrical portion 76 downwardly so that spherical ball or balls or rods 80 will ride on upper edge 86 of tubular portion 72. In FIG. 8, fourth swing arm 20 is pushed upwardly to show its features, but will normally ride in the position shown in FIG. 9, with balls 80 riding either in notches 84 or on upper edge 86 of cylindrical portion. When fourth swing arm 20 is oriented appropriately, spherical ball or balls or rods 80 will be pushed into notches 84, and thereby "lock" swing arm 20 at a predetermined angle relative swing arm 18. By providing four notches set off at 90 degrees from each other, fourth swing arm 20 can be adjusted into four positions. By turning the swing arm, spherical ball or balls or rods 80 will be eased out of notches 84 and will ride again on upper surface 86 of cylindrical portion 72. Other designs of locking means 70 can be used in place of the embodiment shown and described.

One chief advantage of the swing-arm bagging racks 10 and 80 of the invention is that while it occupies roughly the same space as conventional racks designed to support a single style and size of bag pack, it is able to support and allow dispensing of two or three different styles/sizes of bag packs.

The drawings and the foregoing description are not intended to represent the only form of the invention regarding the details of its construction and manner of operation. Indeed, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims.

We, Claim:

1. A swing-arm bagging rack for use in simultaneously carrying multiple styles of packs of plastic bags, comprising:

a back portion with left and right sides;

a first arm portion attached with first hinge means to one of the left and right sides of back portion;

a second arm portion and a third arm portion attached with second hinge means to the other of the left and right sides of back portion, wherein the first and second hinge means comprise a carrier portion affixed to the back portion, the carrier portion having spaced apart rounded upper and lower portions, a rod passing through the carrier portion and riding against the rounded upper and lower portions of the carrier portion, the rod having portions that extend outside of carrier portion, the rod having a protrusion located between the rounded upper and lower portions of the carrier portion, a spring positioned around rod within the carrier portion and riding against the protrusion and against one of the rounded upper and lower portions of the carrier portion to place rod under tension and wherein the first and second arm portions are adapted to carry a first pack of bags and the third arm portion has bag pack retention means positioned thereon to carry a second pack of bags.

2. The swing-arm bagging rack of claim 1 further comprising a fourth arm portion which is hingedly attached to a front region of the third arm portion, the fourth arm portion having bag retention means positioned thereon and adapted for carrying a third pack of bags.

3. The swing-arm bagging rack of claim 2 wherein the bag retention means positioned on the fourth arm portion comprises a pair of body portions having protrusions, the body portions being slideable and lockable on the fourth arm portion.

4. The swing-arm bagging rack of claim 1 wherein the back portion further comprises a catch means.

5. The swing-arm bagging rack of claim 1 wherein the second and third arm portions are attached with the same hinge means to back portion and move together.

6. The swing-arm bagging rack of claim 1, wherein protrusion comprises a pin placed through the rod, and further comprising a position retention plate fixed to one of the rounded upper and lower portions of the carrier portion, the position retention plate having furrows formed therein into which the protrusion can fit, such that when pin is pushed by the spring into one of the furrow on the position retention plate, the rod and its attached arm portions will tend to remain in position absent additional force being applied to rotate the rod.

7. The swing-arm bagging rack of claim 1, wherein the first arm portion is attached to the portion of the rod that extends outside of carrier portion of the first hinge means, and the second and third arm portions are attached to the portions of the rod that extend outside of carrier portion of the second hinge means, and wherein third arm portion has a short bent section which attaches to rod to displace third arm portion a distance from rod.

8. The swing-arm bagging rack of claim 1 wherein the back portion further comprises a bracket means for attaching the swing-arm bagging rack to a wall surface.

9. The swing-arm bagging rack of claim 2 further comprising a hinge locking means for moveably locking the fourth arm portion in at least one predetermined positions relative to the third arm portion.

10. A swing-arm bagging rack for use in simultaneously carrying multiple styles of packs of plastic bags, comprising:

a back portion with left and right sides;

a first arm portion attached with first hinge means to one of the left and right sides of back portion;

a second arm portion and a third arm portion attached with second hinge means to the other of the left and right sides of back portion; and wherein the first and second arm portions are adapted to carrying a first pack of bags and the third arm portion has bag pack retention means positioned thereon to carry a second pack of bags.

11. The swing-arm bagging rack of claim 10 wherein the bag retention means positioned on the fourth arm portion comprises a pair of body portions having protrusions, the body portions being slidable and lockable on the fourth arm portion.

12. The swing-arm bagging rack of claim 10 further comprising a hinge locking means for moveably locking the fourth arm portion in at least one predetermined positions relative to the third arm portion.

13. The swing-arm bagging rack of claim 10 wherein the second and third arm portions are attached with the same hinge means to back portion and move together.

14. The swing-arm bagging rack of claim 10 wherein the back portion further comprises bracket means for attaching the swing-arm bagging rack to a wall surface.

15. The swing-arm bagging rack of claim 10 wherein the back portion further comprises a catch means.

16. The swing-arm bagging rack of claim 10 wherein first and second hinge means comprise a carrier portion affixed to back portion, the carrier portion having spaced apart rounded upper and lower portions, a rod passing through the carrier portion and riding against the rounded upper and lower portions of the carrier portion, the rod having extension portions that extend outside of carrier portion, the rod having a protrusion located between the rounded upper and lower portions of the carrier portion, a spring positioned around the rod within the carrier portion and riding against the protrusion and against one of the rounded upper and lower portions of the carrier portion to place rod under tension.

17. The swing-arm bagging rack of claim 16, wherein the protrusion comprises a pin placed through the rod, and further comprising a position retention plate fixed to one of the rounded upper and lower portions of the carrier portion, the position retention plate having furrows formed therein into which the protrusion can fit, such that when pin is pushed by spring into a furrow on position retention plate, the rod and its attached arm portions will tend to remain in position absent additional force being applied to rotate the rod.

18. The swing-arm bagging rack of claim 16, wherein the first arm portion is attached to the portion of the rod that extends outside of carrier portion of the first hinge means, and the second and third arm portions are attached to the portions of the rod that extend outside of carrier portion of the second hinge means, and wherein third arm portion has a short bent section which attaches to the rod to displace the third arm portion a distance from the rod.

* * * * *